US005116703A

United States Patent [19]

Badesha et al.

[11] Patent Number: 5,116,703

[45] Date of Patent: May 26, 1992

[54] FUNCTIONAL HYBRID COMPOUNDS AND THIN FILMS BY SOL-GEL PROCESS

[75] Inventors: Santokh S. Badesha, Pittsford; Milan Stolka, Fairport; John F. Yanus, Webster; John H. Hodge, Rochester, all of N.Y.

[73] Assignee: Xerox Corporation, Stamford, Conn.

[21] Appl. No.: 451,050

[22] Filed: Dec. 15, 1989

[51] Int. Cl.[5] ..... G03G 5/047

[52] U.S. Cl. ..... 430/59; 430/96; 430/130

[58] Field of Search ..... 430/96, 59, 73, 80, 430/130

[56] References Cited

U.S. PATENT DOCUMENTS

| | | | |
|---|---|---|---|
| 4,181,772 | 1/1980 | Chu et al. | 430/58 |
| 4,275,133 | 6/1981 | Chu et al. | 430/31 |
| 4,473,676 | 9/1984 | Steklenski | 524/32 |
| 4,603,195 | 7/1986 | Babich et al. | 534/564 |
| 4,680,195 | 7/1987 | Pfeifer | 427/44 |
| 4,716,091 | 12/1987 | Yoshihara et al. | 430/96 |
| 4,753,327 | 6/1988 | Yoldas et al. | 427/387 |
| 4,754,012 | 6/1988 | Yoldas et al. | 528/30 |
| 4,780,337 | 10/1988 | Seyferth et al. | 427/387 |
| 4,783,372 | 11/1988 | Pfeifer | 528/435 |
| 4,786,570 | 11/1988 | Yu et al. | 430/58 |
| 4,801,517 | 1/1989 | Frechet et al. | 430/96 |
| 4,965,157 | 10/1990 | Hashimoto et al. | 430/96 |
| 5,008,167 | 4/1991 | Yu | 430/63 |

FOREIGN PATENT DOCUMENTS 100233 4/1988 Japan .

OTHER PUBLICATIONS

G. Wilkes et al, "Ceramers: Hybrid Materials Incorporating Polymeric/Oligomeric Species Into Inorganic Glasses Utilizing A Sol-Gel Approach", ACS Polymer Reprints, 26(2), (1985), pp. 300-301.

R. Roy et al, "Multi-Phasic Ceramic Composites Made by Sol-Gel Technique" *Mat. Res. Soc. Symp. Proc.*, vol. 32 (1984), pp. 347-359.

William H. Pirkle et al, "α-Arylalkylamide-Derived Chiral Stationary Phase Evaluation of Urea Linkages", *Journal of Chromatography*, 322 (1985) pp. 295-307.

T. Sauer et al, "Rigid Rod Polymers From Liquid Crystalline Phthalocyanines" *Makromol. Chem., Macromol. Symp.* 24, (1989) pp. 303-309.

*Primary Examiner*—John Goodrow

*Attorney, Agent, or Firm*—Oliff & Berridge

[57] ABSTRACT

Materials and a process for producing the materials are useful in electrophotographic imaging members. The materials are produced through a sol-gel process wherein a hybrid material, which may be obtained through hydrolysis and condensation, includes an inorganic glassy network, a flexible organic subunit and a functional subunit. The latter two subunits may be unitary. The materials can be easily coated for fabricating electrophotographic imaging members and the like.

34 Claims, 1 Drawing Sheet

FUNCTIONAL HYBRID COMPOUNDS AND THIN FILMS BY SOL-GEL PROCESS

BACKGROUND OF THE INVENTION

This invention relates in general to electrophotography and, in particular, to hybrid compounds, thin films and processes for preparing and using the hybrid compounds and thin films.

In fabricating electrophotographic imaging members, there is a need for materials which can be easily prepared and which have greater mechanical stability. There are known a number of methods and materials for forming electrophotographic imaging members. Roy et al, "Multi-phase Ceramic Composites Made by Sol-Gel Technique," Mat. Res. Soc. Symp. Proc., Vol. 326, 1984, discloses the formation of photoconductive foams or species such as ZnO and CdS dispersed in inorganic gels. In these and other related work, the emphasis is on dispersing functional subunits in a glassy network. However, since these hybrid materials are dispersions, there are problems related to their stability, due to the lack of chemical bonding.

The sol-gel process allows the preparation of a variety of inorganic ceramic glasses at low temperatures. Generally, a sol is formed from a solution of inorganic intermediate particles in a solvent by partial hydrolysis. The sol is then polymerized through condensation to form a gel. A polymeric network is ultimately obtained by drying the gel to remove solvent and reaction by-products trapped in the condensed product.

The concept of the sol-gel process is known and has been employed in various fields. For example, Yoldas et al in U.S. Pat. Nos. 4,753,827 and 4,754,012 disclose organoalkoxysilane/metal oxide sol-gel compositions which are abrasion-resistant, and a method for their production. An organoalkoxysilane or mixture of organoalkoxysilanes is mixed with a metal alkoxide or mixture of metal alkoxides. The mixture is hydrolyzed, condensed and dried to form a organosiloxane/metal oxide abrasion-resistant coating.

Thin films of hybrid material composed of a silica network and polysiloxane flexible subunits have been disclosed by G.L. Wilkes et al, "Ceramics: Hybrid Materials Incorporating Polymeric/Oligomeric Species into Inorganic Glasses utilizing a Sol-Gel Approach," Polymer. Prep., Vol. 26, No. 3, page 300, 1985. The hybrid material was prepared by, first, hydrolysis of tetraethoxyorthosilicate (TEOS) to hydroxy terminated silicate, followed by condensation reaction with hydroxy terminated polydimethylsiloxane.

There continues to be a need for fabricating materials which have various functionalities and properties. In particular, it is desirable to fabricate materials with functionalities having properties including release properties, dielectric properties, and other desirable electrophotographic (charge generating and charge transporting) electrical, magnetic and optical properties (hereinafter "photoresponsive properties"). Some of these properties are of particular interest in electrophotography.

In electrophotography, an electrophotographic plate containing a photoconductive insulating layer on a conductive substrate is imaged by first uniformly electrostatically charging its surface. The plate is then exposed to a pattern of activating electromagnetic radiation such as light. The radiation selectively dissipates the charge in the illuminated area of the photoconductive insulating layer while leaving behind an electrostatic latent image in the non-illuminated area. This electrostatic latent image may then be developed to form a visible image by depositing finely divided toner particles on the surface of the photoconductive insulating layer. The resulting visible image may then be transferred from the electrophotographic plate to a support such as paper. This imaging process may be repeated many times with reusable photoconductive insulating layers.

An electrophotographic imaging member may be provided in a number of forms. For example, the imaging member may be a homogeneous layer of a single material such as vitreous selenium or it may be a composite layer containing a photoconductor and another material. One type of composite imaging member comprises finely divided particles of photoconductive inorganic compound dispersed in an electrically insulating organic resin binder. U.S. Pat. No. 4,265,990 discloses a layered photoreceptor having separate photogenerating and charge transport layers. The photogenerating layer is capable of photogenerating holes and injecting the photogenerated holes into the charge transport layer.

Other composite imaging members have been developed having numerous layers which are highly flexible and exhibit predictable electrical characteristics within narrow operating limits to provide excellent images over many thousands of cycles. One type of multilayered photoreceptor that has been employed as a belt in electrophotographic imaging systems comprises a substrate, a conductive layer, a blocking layer, an adhesive layer, a charge generating layer, a charge transport layer and a conductive ground strip layer adjacent to one edge of the imaging layers. This photoreceptor may also comprise additional layers such as an anti-curl back coating and an optional overcoating layer.

The supporting substrate may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like. The electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E.I. du Pont de Nemours & Co., or Melinex available from ICI Americas Inc.

The thickness of the substrate layer depends on numerous factors, including economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example less than 50 micrometers, provided there are no adverse effects on the final photoconductive device.

The electrically conductive ground plane may be an electrically conductive metal layer which may be formed, for example, on the substrate by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer may be between about 20 Angstroms to about 750 Angstroms, and more preferably from about 50 Angstroms to about 200 Angstroms for an optimum combination of electrical conductivity, flexibility and light transmission.

After deposition of the electrically conductive ground plane layer, the charge blocking layer may be applied thereto. Electron blocking layers for positively charged photoreceptors allow holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer may be utilized. The hole blocking layer may include polymers such as polyvinylbutyrol, epoxy resins, polyesters, polysiloxanes, polyamides, polyurethanes and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl, di(dodecyl-benzene sulfonyl) titanate, isopropyl di(4-aminobenzoyl)isostearoyl titanate, isopropyl tri(N-ethylamino-ethylamino)-titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $]H_2N(CH_2)_4]CH_3Si(OCH_3)_2$, (gamma-aminobutyl) methyl diethoxysilane, and $[H_2N(CH_2)_2]CH_3Si(OCH_3)_2$ (gamma aminobutyl) methyl diethoxysilane, as disclosed in U.S. Pat. Nos. 4,291,110, 4,338,387, 4,286,033 and 4,291,110. A preferred hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. The hydrolyzed silanes have the general formula

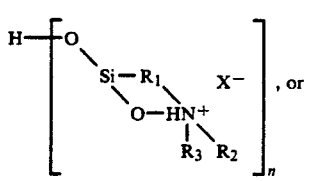

I

-continued

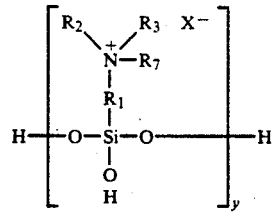

II wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and y is 1–4. The imaging member is preferably prepared by depositing on the metal oxide layer of a metal conductive layer, a coating of an aqueous solution of the hydrolyzed aminosilane at a pH between about 4 and about 10, drying the reaction product layer to form a siloxane film and applying an adhesive layer, and thereafter applying electrically operative layers, such as a photogenerator layer and a hole transport layer, to the siloxane film.

The hole blocking layer should be continuous and have a thickness of less than about 0.5 micrometers because greater thicknesses may lead to undesirably high residual voltage. A hole blocking layer of between about 0.005 micrometer and about 0.3 micrometers is preferred because charge neutralization after the exposure step is facilitated and optimum electrical performance is achieved. A thickness of between about 0.03 micrometer and about 0.06 micrometer is preferred for metal oxide layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

In most cases, intermediate layers between the injection blocking layer and the adjacent charge generating or photogenerating layer may be desired to promote adhesion. For example, an adhesive layer may be employed. If such layers are utilized, they preferably have a dry thickness between about 0.001 micrometer to about 0.2 micrometer. Typical adhesive layers include film-forming polymers such as polyester, du Pont 49,000 resin (available from E.I. du Pont de Nemours & Co.), polyvinylbutyral, polyvinylpyrolidone, polyurethane, polymethyl methacrylate, and the like.

Any suitable charge generating (photogenerating) layer may be applied to the adhesive layer which can then be coated over with a contiguous hole transport layer as described. Examples of materials for photogenerating layers include inorganic photoconductive particles such as amorphous selenium, trigonal selenium, and selenium alloys selected from the group consisting of selenium-tellurium, selenium-tellurium-arsenic, selenium arsenide and phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones available from du Pont under the tradename Monastral Red, Monastral Violet and Monastral Red Y, Vat orange 1 and Vat orange 3 trade names for dibromoanthanthrone pigments, benzimidazole perylene, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like, dispersed in a film forming polymeric binder. Multi-photogenerating layer compositions may be utilized where a photoconductive layer enhances or reduces the properties of the photogenerating layer. Examples of this type of configuration are described in U.S. Pat. No. 4,415,639. Other suitable photogenerating materials known in the art may also be utilized, if desired. Charge generating layers comprising a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures thereof are expecially preferred because of their sensitivity to white light. Vanadyl phthalocyanine, metal free phthalocyanine and tellurium alloys are also preferred because these materials provide the additional benefit of being sensitive to infra-red light.

Any suitable polymeric film forming binder material may be employed as the matrix in the photogenerating layer. Typical polymeric film forming materials include those described, for example, in U.S. Pat. No. 3,121,006. The binder polymer should adhere well to the adhesive layer, dissolve in a solvent which also dissolves the upper surface of the adhesive layer and be miscible with the copolyester of the adhesive layer to form a polymer blend zone. Typical solvents include tetrahydrofuran, cyclohexanone, methylene chloride, 1,1,1-trichloroethane, 1,1,2-trichloroethane, trichloroethylene, toluene, and the like and mixtures thereof. Mixtures of solvents may be utilized to control evaporation range. For example, satisfactory results may be achieved with a tetrahydrofuran to toluene ratio of between about 90:10 and about 10:90 by weight. Generally, the combination of photogenerating pigment, binder polymer and solvent should form uniform dispersions of the photogenerating pigment in the charge generating layer coating composition. Typical combinations include polyvinylcarbazole, trigonal selenium and tetrahydrofuran; phenoxy resin, trigonal selenium and toluene; and polycarbonate resin, vanadyl phthalocyanine and methylene chloride. The solvent for the charge generating layer binder polymer should dissolve the polymer binder utilized in the charge generating layer and be capable of dispersing the photogenerating pigment particles present in the charge generating layer.

The photogenerating composition or pigment may be present in the resinous binder composition in various amounts. Generally, from about 5 percent by volume to about 90 percent by volume of the photogenerating pigment is dispersed in about 10 percent by volume to about 90 percent by volume of the resinous binder. Preferably from about 20 percent by volume to about 30 percent by volume of the photogenerating pigment is dispersed in about 70 percent by volume to about 80 percent by volume of the reinous binder composition. In one embodiment about 8 percent by volume of the photogenerating pigment is dispersed in about 92 percent by volume of the resinous binder composition.

The photogenerating layer generally ranges in thickness from about 0.1 micrometer to about 5.0 micrometers, preferably from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved. Any suitable and conventional technique may be utilized to mix and thereafter apply the photogenerating layer coating mixture to the previously dried adhesive layer. Typical application techniques include spraying, dip coating, roll coating, wire wound rod coating, and the like. Drying of the deposited coating may be effected by any suitable conventional technique such as oven drying, infrared radiation drying, air drying and the like, to remove substantially all of the solvents utilized in applying the coating.

The active charge transport layer may comprise any of the hybrid materials disclosed herein, provided the material is capable of supporting the injection of photogenerated holes and electrons from the charge generating layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerogrpahy, e.g. 4000 Anstroms to 9000 Angstroms. The charge transport layer is substantially transparent to radiation in a region in which the photoconductor is to be used. It is comprised of a substantially non-photoconductive material which supports the injection of photogenerated holes from the charge generating layer. The active charge transport layer is normally transparent when exposure is effected therethrough to ensure that most of the incident radiation is utilized by the underlying charge generating layer. When used with a transparent substrate, imagewise exposure or erasure may be accomplished through the substrate with all light pa-sing through the substrate. In this case, the active charge transport material need not transmit light in the wavelength region of use. The charge transport layer in conjunction with the charge generating layer is an insulator to the extent that an electrostatic charge placed on the charge transport layer is not conducted in the absence of illumination.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in multilayer photoconductors comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises an aromatic amine compound of one or more compounds having the general formula:

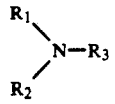

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl groups having from 1 to 18 carbon atoms and cycloaliphatic compounds having from 3 to 18 carbon atoms. The substituents should be free from electron withdrawing groups such as $NO_2$ groups, CN groups, and the like. Typical aromatic amine compounds that are represented by this structural formula include:

I. Triphenyl amines such as:

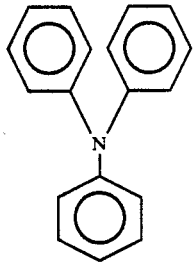

II. Bis and poly triarylamines such as:

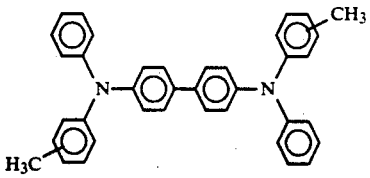

III. Bis arylamine ethers such as:

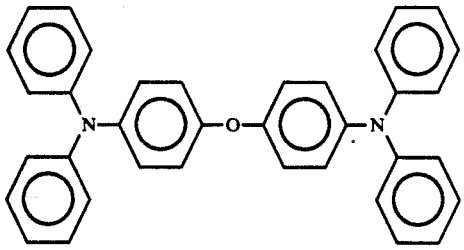

and

IV. Bis alkyl-arylamines such as:

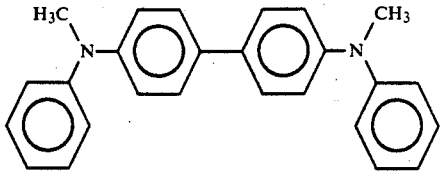

A preferred aromatic amine compound has the general formula:

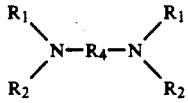

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free from electron withdrawing groups such as $NO_2$ groups, CN groups, and the like.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4''-bis (diethylamino)-2',2''-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(3''-methylphenyl)-(1,1'biphenyl) -4,4'-diamine, and the like, dispersed in an inactive resin binder.

Any suitable inactive resin binder soluble in methylene chloride or other suitable solvent may be employed. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these in binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; a polycarbonate resin having a molecular weight of from about 50,000 to about 100,000, available as Makrolon from Farben Fabricken Bayer A.G.; a polycarbonate resin having a molecular weight of from about 20,000 to about 50,000 available as Merlon from Mobay Chemical Company; polyether carbonates; and 4,4'-cyclohexylidene diphenyl polycarbonate. Methylene chloride solvent is a desirable component of the charge transport layer coating mixture for adequate dissolving of all the components and for its low boiling point.

An especially preferred multilayered photoconductor comprises a charge generating layer comprising a binder layer of photoconductive material and a contiguous hole transport layer of a polycarbonate resin material having a molecular weight of from about 20,000 to about 120,000 having dispersed therein from about 25 to about 75 percent by weight of one or more compounds having the general formula:

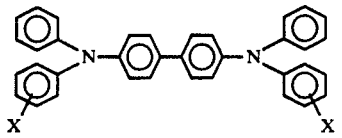

wherein X is selected from the group consisting of an alkyl group, having from 1 to about 4 carbon atoms and chlorine, the photoconductive layer exhibiting the capability of photogeneration of holes and injection of the holes, the hole transport layer being substantially nonabsorbing in the spectral region at which the photoconductive layer generates and injects photogenerated holes but being capable of supporting the injection of photogenerated holes from the photoconductive layer and transporting the holes through the hole transport layer.

The ground strip may comprise materials which include those enumerated in U.S. Pat. No. 4,664,995. The ground strip may comprise a film forming polymer binder, and electrically conductive particles. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The anti-curl layer may comprise organic polymers or inorganic polymers that are electrically insulating or slightly semi-conductive. The anti-curl layer provides flatness and/or abrasion resistance.

An optional overcoating layer may be provided over the charge transport layer. The overcoating layer may comprise organic polymers or inorganic polymers that are electrically insulating or slightly semi-conductive.

There continues to be a need for materials for fabricating photoresponsive imaging members which are mechanically stable and which provide electrical, mechanical and other properties necessary for a photoresponsive imaging member.

SUMMARY OF THE INVENTION

It is an object of the invention to provide materials for photoresponsive imaging members which overcome the shortcomings of the prior art.

It is a further object of the invention to provide materials for a photoresponsive imaging member which have particular functionalities for imparting various desirable electrical and mechanical properties.

It is an object of the invention to provide novel charge generating and charge transporting materials for use in photoresponsive imaging members.

It is a further object of the invention to provide charge generating and charge transporting materials in which the functional subunits are chemically bonded in place.

It is also an object of the invention to provide a process for fabricating the novel materials.

Yet another object of the invention is to provide imaging members which are photochemically stable.

Another object of the invention is to provide imaging members which are thermally stable.

It is also an object of the invention to provide imaging members which are chemically stable.

These and other objects of the invention are achieved by chemically bonding an inorganic glassy subunit, a flexible organic subunit and a functional photoresponsive subunit through hydrolysis and condensation to form a hybrid material.

BRIEF DESCRIPTION OF THE DRAWINGS

A more complete understanding of the invention can be obtained by reference to the accompanying Figure which is a cross-sectional view of a multilayer photoreceptor which may incorporate the material of the invention.

DETAILED DESCRIPTION OF PREFERRED EMBODIMENTS

Figure 1:
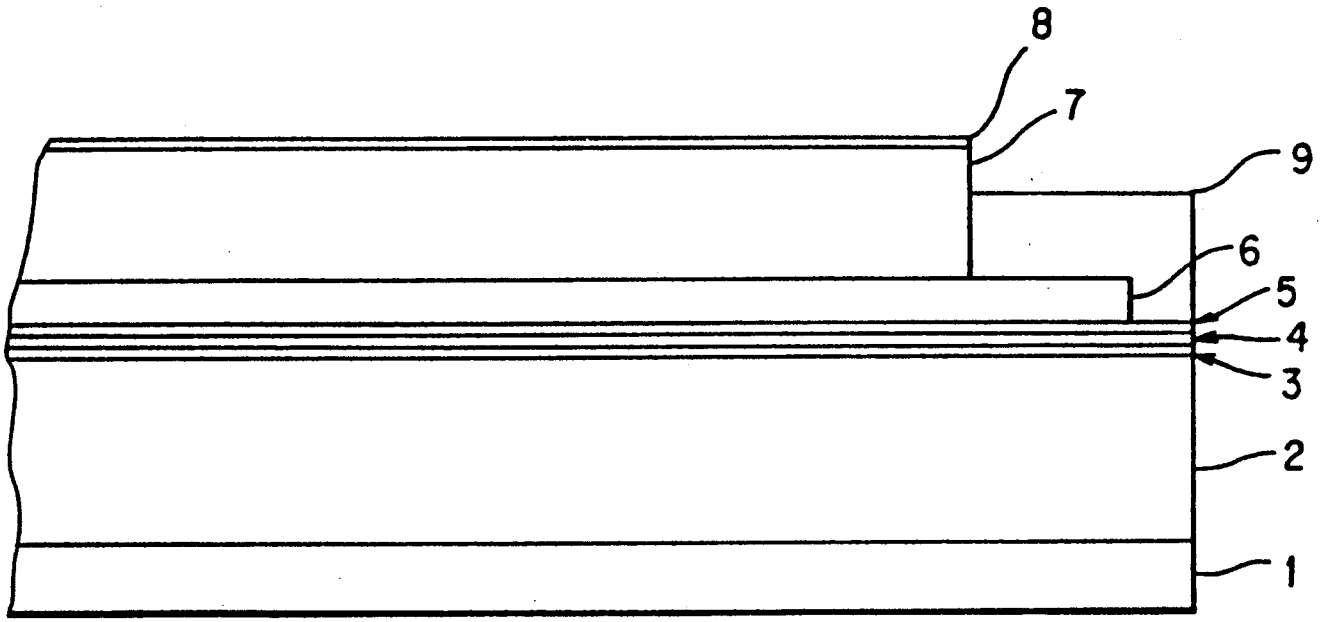

The hybrid material of the present invention is comprised of three major components: (1) an inorganic glassy network subunit; (2) a flexible organic subunit; and (3) a functional subunit. The inorganic glassy network subunit may be obtained from any of a number of inorganic materials which will undergo hydrolysis and condensation, such as alkoxides, acids, halides and oxalates. The flexible organic subunit may be a polymer having, for example, mechanical properties which are desirable to incorporate into the hybrid material, such as flexibility or film forming properties. The functional subunit may be chosen to have various properties, such as release properties, dielectric properties, desirable electrophotographic (charge generating and charge transporting), electrical, magnetic and optical properties (hereinafter "photoresponsive properties"). The functional subunit and the flexible organic subunit may be combined as a single subunit in one embodiment.

The material of the invention may be obtained through a sol-gel process. The precursors for the subunits of the invention initially have reactive end groups so that they can be chemically bonded to each other through the sol-gel process.

The glassy network may preferably be incorporated into the material of the present invention through the use of a material having the general formula $M[X]_n$. The material of the formula $M[X]_n$ may be a material which will undergo hydrolysis and condensation, such as metal alkoxides, acids, halides, acetates and oxalates.

For example, M may be a Group V or Group VI metal such as Si, Al, Ti, Cu, Fe, As, Se and Te. X may be an alkoxide or aryloxide group of the formula OR, where R represents an alkyl or aryl group having from 1 to 20 carbon atoms. X may also be a halogen group such as chloro, bromo, iodo and fluoro. In the above formula, n is equal to the valence value of M. The material may be a metal alkoxide in dimer or higher condensed forms so long as the X groups remain reactive. In a preferred form of the invention, $M[X]_n$ is tetraethoxyorthosilicate (TEOS).

The organic subunit of the invention may be obtained from a polymer precursor initially having one or more reactive end groups. For a continuous, extended structure, the polymeric precursors initially have two or more reactive groups which react with the glassy network and the functional precursors to form an extended compound. If only one reactive group is provided on the polymeric precursor, then the polymeric precursor should also have photoresponsive properties. The reactive group reacts with the glassy network. Alternatively, two or more reactive groups may be provided with such a polymeric precursor to form a more intimately bonded structure.

The polymeric precursor includes virtually any hydroxy terminated polymer or precursor thereof, preferably polysiloxanes or polyols. Hydroxy terminated, vinyl terminated, chloro terminated and alkoxy terminated polysiloxanes are the most useful. An example is diethoxy terminated polydimethylsiloxane. The ethoxy groups undergo hydrolysis to hydroxy groups which then take part in the condensation reaction of the sol-gel scheme. As polyols, one may use, for example, polyethylene or polypropylene glycols or polybutadiene diols.

The molecular weight of the polymer should be high enough to give mechanical flexibility to the resulting hybrid material. The range of molecular weight for polysiloxanes may be from about 300 daltons to about 10,000 daltons. It is preferably from about 700 daltons to about 4000 daltons. The range of molecular weight for polyols may be from about 200 daltons to about 20,000 daltons. It is preferably between about 500 daltons and 3500 daltons.

Two or more polysiloxanes or polyols, or a combination of polysiloxanes and polyols may also be used. A combination, for example, of a polyethylene glycol and polydimethyl siloxane may be used. In some cases, it may be desirable to use more than one polymer to achieve the required mechanical properties.

The precursor from which the functional subunit is obtained, like the glassy network subunit and organic subunit, initially contains one or more reactive groups. The functional subunit may be a material having various functionalities, such as "photoresponsive properties". For example, the functional subunit can be a material which is suitable as a charge transport material or as a charge generating material. Suitable charge transport materials include pyrazolins, oxadiazoles, hydrazones, triphenylamines, triphenylmethane derivatives, trinitro fluorenone (TNF), (alkoxycarbonyl fluorenylidene) malononitriles such as butoxycarbonyl fluorenylidene malononitrile (BCFM) and the like. Suitable charge generating materials include thiopyrylium, phthalocyanines, azo pigments, perylenes, carbocyanines, squaraine, iminoisoindolins, and the like. Phthalocyanines include alkoxy-substituted silicon dihydroxyphthalocyanines such as those disclosed by Sauer et al, "Rigid Rod Polymers from Liquid Crystalline Phthalocyanines," Makromol. Chem., Macromol. Symp., vol. 24, pp. 303-309(1989), and preferably include silicon dihydroxy phthalocyanine and vanadium dihydroxyphthalocyanine. One requirement for all these materials is to have functionalities, such as hydroxy, alkoxy, and chloro, which will take part in the sol-gel reaction, so that the molecules can be chemically bonded to the inorganic and/or organic subunit. U.S. Pat. No. 4,515,882 contains specific examples of such materials.

Preferred material include triarylamines (TAA) and their analogues, an example of which may be represented by the formula:

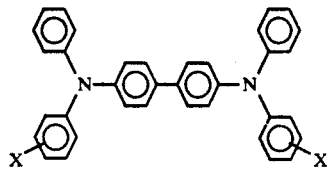

wherein X may be selected from halogen, hydroxy, alkoxy and amino, preferably hydroxy and alkoxy. For example, when X is hydroxy, the compound is a dihydroxy derivative of N,N'-diphenyl-N,N'-bis(hydroxyphenyl)-(1,1'-biphenyl)-4,4'-diamine. This compound will be referred to hereinafter as dihydroxy-TAA. Reference to TAA hereinafter will be meant to refer to any of a number of triarylamines having the above formula.

It may be desirable to derivatize the functional precursor material and/or the polymeric material so that it will be more appropriately reactive. Derivatization is meant to include any process or method which will make a particular material more or less reactive with the reactive groups contained in the precursors for the glassy network and polymeric subunits. For example, a portion or group of the functional material may be replaced with a more reactive portion or group, without adversely affecting its functionality. Derivatization may, for example, be carried out with a compound having a formula $y—CH_2)_n\text{-}Si(X)_3$, where y may be isocyanate or thiocyanate. The condition here is that y must react with the functionality on the arylamine so that that end of the compound may be anchored on the triarylamine. n is the number of methylene units and may range from 1 to 20, preferably 3 to 10. X may be, for example, hydroxy, alkoxy, halo or amino, and is preferably alkoxy. The derivatization in a particular example using dihydroxy-TAA replaces hydroxy groups of the TAA with alkoxy groups which may be more reactive with the reactive groups of the inorganic glassy network and polymeric precursors.

The final hybrid material of the invention may be represented by the formula G-D-F wherein G is the inorganic glassy network, D is the organic subunit, and F is the functional subunit. A representative hybrid material utilizing TAA is as follows:

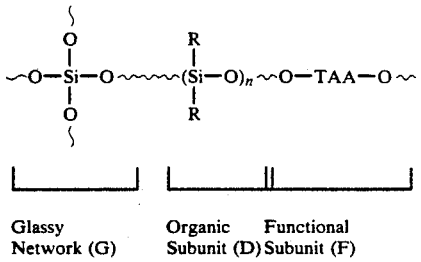

In the above formula, the wavy lines represent a continuation of the matrix-like structure.

The general character of the sol-gel scheme for producing materials of the present invention involves forming a sol comprised of the precursors for the glassy network, polymeric subunit and functional subunit, condensing the sol to form a gel, and then drying the gel. The precursors may be hydrolyzed, if necessary, together in solution or separately. In the case of utilizing a metal alkoxide to form the glassy network, the metal alkoxide may be hydrolyzed as follows:

$$M(OR)_n + nH_2O \rightarrow M(OH)_n + nROH$$

$$M(OH)_n \rightarrow (MO_n/2)_x + n/2\ H_2O$$

where n is the valence state of M. The organic and functional precursors may be added to this mixture before, during or after hydrolysis. Hydrolysis is generally carried out under acid conditions at low temperatures. The pH may vary from about 1 to 6, and is preferably between 2–4. Temperature may vary between about 20° C. to about 150° C. and depends upon the solvent and the precursors used. The preferred temperature is between about 25° C. and 75° C. The precursors for the functional subunit and any separate polymeric subunit may be added to the hydrolyzed solution for the glassy network component or may be added prior to hydrolysis. The functional and polymeric subunits do not have to be added at the same step. A variety of solvents or mixtures of solvents may be used, and include: aromatic hydrocarbons, e.g., benzene, toluene, xylene; aliphatic hydrocarbons, e.g., petroleum ethers, hexane, heptane; alcohols, e.g. methanol, ethanol, propanol, butanol; ethers, e.g., tetrahydrofuran, 1,4-dioxane, dialkyl or diphenyl ethers. Preferred solvents are propanol, toluene and tetrahydrofuran and mixtures thereof. A specific solvent is chosen based on the solubility of the precursors for the various subunits. For tetraethoxyorthosilicate (precursor for the inorganic network), diethoxypolydimethylsiloxane (organic polymer precursor) and silanylated-triarylamine (functional precursor), a mixture of propanol and toluene (1:1) is preferred.

The rate of hydrolysis (if more than one hydrolyzable component is in the solution) and condensation should be comparable for all the precursors involved in the sol-gel reaction to obtain a uniform matrix of the subunits. The amounts of each subunit can be controlled by choosing relative reactivities for each precursor. In other words, the proportion of a particular subunit in the compound will be greater when its precursor has a relatively greater reactivity compared to the other precursors.

After hydrolysis and condensation are complete, the material is dried to remove solvent and reaction by-products which may have become trapped in the glassy network. Rapid drying conditions tend to produce a spongy material, whereas slower drying conditions produce a more condensed network.

The gel obtained from this process can be coated on a substrate for fabricating thin layers. Conventional coating techniques may be utilized to apply the hybrid material to a substrate in the form of a thin film. Typical coating techniques include solvent coating, extrusion coating, spray coating, lamination, dip coating, solution spin coating and the like.

In one embodiment of the invention, the condensation reaction can be carried out utilizing two components. More specifically, a material having both the desired polymeric properties and the desired functional properties can be reacted with the inorganic glassy network precursor. In other words, the functional subunit has the requisite polymeric properties and can be reacted directly with the inorganic glassy network precursor. As an example, polysilylenes having the formula

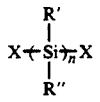

wherein X may be halo, hydroxy, alkoxy, etc., and R′ and R″ may be alkyl or aryl, may be reacted with the inorganic glassy network precursor. Preferably, X is ethoxy, R′ is phenyl and R″ is methyl. Polysilylenes may be utilized to provide hole transport properties in an electrophotographic imaging member. Polyvinylcarbazole may also be used to provide the desired polymeric and functional properties. As in the first embodiment, derivatization may be performed to obtain a more reactive material.

Other compounds having the desired polymeric and functional properties include compounds of the formula

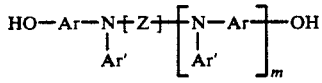

wherein m=0,1

Z is selected from the group consisting of:

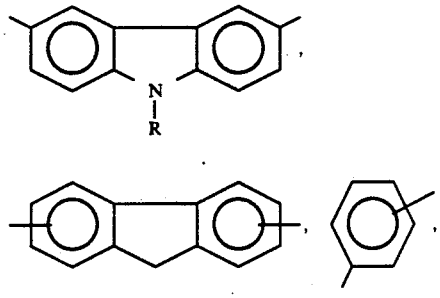

-continued

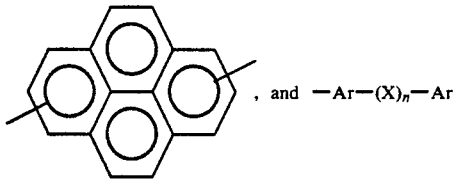

n is 0 or 1,

Ar is selected from the group consisting of:

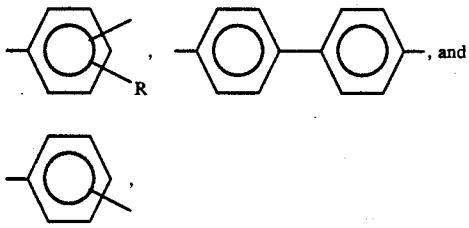

R is selected from the group consisting of $-CH_3$, $-C_2H_5$, $-C_3H_7$, and $-C_4H_9$, Ar' is selected from the group consisting of:

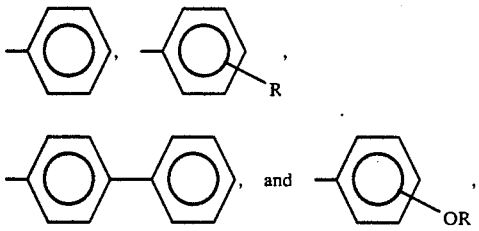

X is selected from the group consisting of:

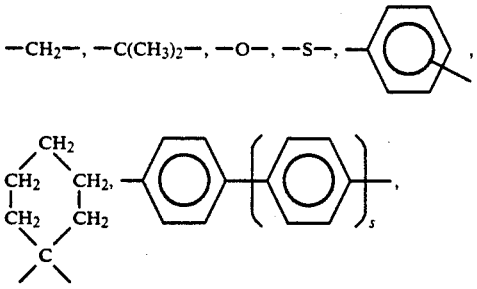

-continued

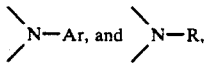

s is 0, 1 or 2, and

X' is an alkylene radical selected from the group consisting of alkylene and isoalkylene groups containing 2 to 10 carbon atoms. Derivatization may also be performed to obtain a more reactive material.

The materials of the present invention may be used in various layers of photoresponsive imaging members. For such uses, the functional subunit should be selected to impart necessary properties to the subject layer(s). For example, charge transport layers or charge generating layers may be formed from hybrid compounds of the invention having functional groups with charge transporting or charge generating properties. Overcoating layers may be formed from hybrid compounds of the invention having functional groups with release properties. The resultant imaging member layers contain the functional subunits in finely dispersed, chemically bonded form. They are photochemically, chemically, thermally and mechanically stable.

The Figure shows a representative structure of an electrophotographic imaging member which may use the material of the invention. The imaging member is provided with an anti-curl back coating layer 1, a supporting substrate 2, an electrically conductive ground plane layer 3, a hole blocking layer 4, an adhesive layer 5, a charge generating layer 6, a charge transport layer 7, an optional overcoating layer 8, and a ground strip layer 9.

The present invention will be further understood from the non-limitative examples which follow.

EXAMPLE I

A hybrid composition is prepared starting from tetraethoxyorthosilicate (TEOS), $(C_2H_5O)_2PDMS$ and carbamate (A) in a ratio of 45:30:25 by weight. Carbamate (A) may be obtained in accordance with Pirkle et al,, "α-Arylalkylamine-Derived Chiral Stationary Phases Evaluation of Urea Linkages", Journal of Chromatography, Vol. 322, pp. 295 -307 (1985). A mixture of tetrahydrofuran (THF) and isopropanol is used as solvent. Hydrochloric acid is used as a catalyst. The mixture is kept under reflux for hydrolysis and condensation.

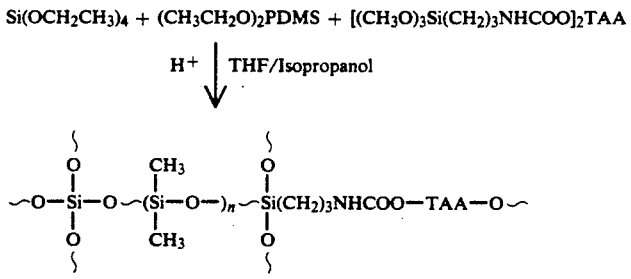

+ ethanol and methanol byproducts

Clear flexible free standing thin films are prepared by pouring the mixture into petri dishes. These films fluoresce under ultraviolet light indicating homogeneous dispersion of TAA into the films. Layered electrophotographic imaging members are fabricated by coating thin charge transport layers from the gel of the above hybrid composition on a vacuum deposited $As_2Se_3$ charge generating layer on an aluminum substrate. These devices are tested in a flat plate scanner and show good electrical discharger.

EXAMPLE II

A hybrid composition is prepared containing tetrahydroxy TAA ](OH)$_4$TAA] derivatized using isocyanatopropyltrimethoxysilane. It is subjected to a sol-gel reaction to obtain the following material:

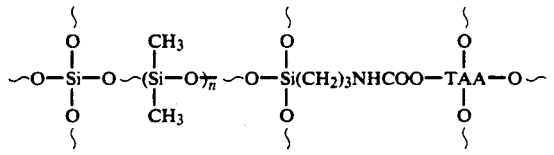

A layered device is fabricated having a layer formed from the above hybrid material. In particular, a device is fabricated having a substrate layer of aluminized Mylar, a charge generating layer of vacuum deposited amorphous selenium, and a charge transport layer of the hybrid material. The device is then tested in a flat plate scanner. When charged negatively, followed by exposure to 4,330 angstrom radiation, the device shows good discharge.

Although the invention has been described with respect to specific preferred embodiments, it is not intended to be limited thereto. Those skilled in the art will recognize that variations and modifications can be made therein which are within the spirit of the invention and the scope of the claims.

What is claimed is:

1. A multilayer electrophotographic imaging member, comprising at least one photoresponsive layer, wherein at least one layer of said imaging member is composed of a compound containing subunits of the formula G-D-F, wherein G is an inorganic glassy network subunit, D is a flexible organic subunit, and F is a subunit having charge transporting or generating characteristics.

2. The imaging member of claim 1, wherein G is a metal oxide glassy network subunit, D is a polymeric subunit, and F is a photoresponsive subunit.

3. The imaging member of claim 2, wherein the metal of said metal oxide glassy network subunit is at least one Group V or Group VI metal.

4. The imaging member of claim 3, wherein said metal is selected from the group consisting of Si, Al, Ti, Cu, Fe, As, Se and Te.

5. The imaging member of claim 3, wherein said metal is Si.

6. The imaging member of claim 2, wherein D is selected from the group consisting of polysiloxane, polysiloxane derivatives and polyols.

7. The imaging member of claim 2, wherein D is an alkoxy derivative of polysiloxane having from 1 to 20 carbon atoms.

8. The imaging member of claim 2, wherein D is an aryloxy derivative of polysiloxane having from 1 to 20 carbon atoms.

9. The imaging member of claim 2, wherein D is selected from the group consisting of diethoxy terminated-polydimethylsiloxane and divinyl terminated-polydimethylsiloxane.

10. The imaging member of claim 2, wherein D is selected from the group consisting of polypropylene glycol and polyethylene glycol.

11. The imaging member of claim 2, wherein F is formed from substituted triarylamines.

12. The imaging member of claim 2, wherein F is formed from derivatized TAA.

13. The imaging member of claim 1, wherein said compound is prepared by a sol-gel reaction.

14. The imaging member of claim 1, wherein said compound is the condensation polymerization reaction product of:

a) an inorganic glassy network forming material;
b) a polymer having reactive terminal groups; and
c) a functional compound having at least one reactive terminal group.

15. The imaging member of claim 14, wherein said reactive terminal group of said functional compound is selected from the group consisting of hydroxy, alkoxy and halo.

16. The imaging member of claim 1, wherein said compound is the product of a process comprising the steps of:

a) hydrolyzing an inorganic glassy network precursor;
b) forming a sol by adding to said inorganic glassy network precursor a polymer precursor having reactive end groups, and a functional precursor having at least one reactive end group; and
c) condensing said inorganic glassy network precursor, polymer precursor and functional precursor to obtain said photoresponsive compound.

17. The imaging member of claim 16, wherein said inorganic glassy network precursor is a metal alkoxide of the formula $$M(OR)_n$$

wherein M is a metal, R is an alkyl group and n is a valence state of said metal.

18. An imaging member, comprising a layer of a photoresponsive compound made by a process comprising the steps of:

a) hydrolyzing a metal alkoxide;
b) for.ning a sol by adding to said metal alkoxide a functional precursor, having polymeric and photoresponsive properties, which will participate in a sol-gel reaction; and
c) condensing said metal alkoxide with said functional precursor to form a gel.

19. The imaging member of claim 18, wherein said functional precursor contains a polymeric portion and a functional portion.

20. The imaging member of claim 18, wherein said metal alkoxide is tetraethoxyorthosilicate.

21. The imaging member of claim 18, wherein said functional precursor is selected from the group consisting of a polysilylene and a polyvinylcarbazole.

22. An imaging member comprising a layer of a compound containing subunits of the formula G-E, wherein G is an inorganic glassy network unit and E is a functional subunit having polymeric and photoresponsive properties.

23. The imaging member of claim 22, wherein said inorganic glassy network subunit comprises a metal oxide.

24. The imaging member of claim 22, wherein said functional subunit contains a first polymeric portion and a second photoresponsive portion.

25. The imaging member of claim 22, wherein said functional subunit is selected from the group consisting of polyvinylcarbazole and polysilylene.

26. The imaging member of claim 22, wherein said functional subunit is a derivative of

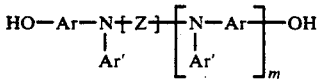

wherein:

m=0 or 1

Z is selected from the group consisting of:

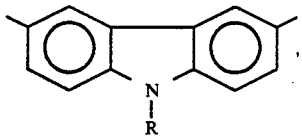

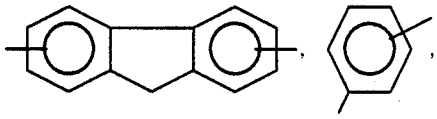

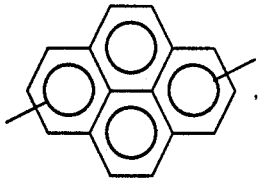

, and $-Ar-(X)_n-Ar$ n is 0 or 1,

Ar is selected from the group consisting of:

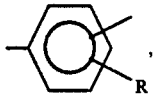

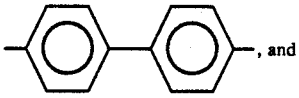

, and

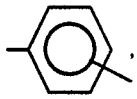

R is selected from the group consisting of $-CH_3$, $-C_2H_5$, $-C_3H_7$, and $-C_4H_9$, Ar' is selected from the group consisting of:

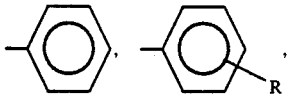

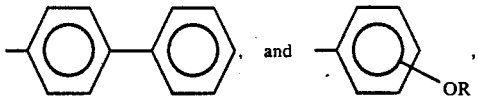

and

X is selected from the group consisting of:

$-CH_2-$, $-C(CH_3)_2-$, $-O-$, $-S-$,

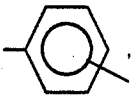

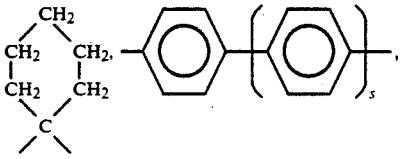

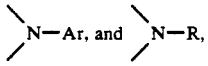

s is 0, 1, or 2, and

X' is an alkylene radical selected from the group consisting of alkylene and isoalkylene groups containing 2 to 10 carbon atoms.

27. The imaging member of claim 22, wherein said imaging member is obtained by hydrolyzing a metal alkoxide of the formula $M(OR)_n$, wherein M is a Group V or Group VI metal, R is an alkyl or an aryl group having from 1 to 20 carbon atoms, and n is the valence state of said metal, and condensing said hydrolyzed metal alkoxide with a reactive precursor for said functional subunit.

28. The imaging member of claim 22, wherein said functional subunit has charge transporting characteristics.

29. The imaging member of claim 22, wherein said functional subunit has charge generating characteristics.

30. The electrophotographic imaging member of claim 1, wherein said layer is a charge transporting layer and F has charge transporting characteristics.

31. The electrophotographic imaging member of claim 30, wherein F is a TAA derivative.

32. The electrophotographic imaging member of claim 1, wherein said layer is a charge generating layer and F has charge generating characteristics.

33. The electrophotographic imaging member of claim 32, wherein F is a phthalocyanine.

34. The electrophotographic imaging member of claim 33, wherein said phthalocyanine is selected from the group consisting of silicon dihydroxy phthalocyanine and vanadium dihydroxyphthalocyanine.

* * * * *